US010857785B2

(12) United States Patent
Hirai et al.

(10) Patent No.: US 10,857,785 B2
(45) Date of Patent: Dec. 8, 2020

(54) LIQUID EJECTING HEAD, LIQUID EJECTING UNIT, LIQUID EJECTING APPARATUS, AND PIEZOELECTRIC DEVICE

(71) Applicant: SEIKO EPSON CORPORATION, Tokyo (JP)

(72) Inventors: Eiju Hirai, Azumino (JP); Hiroaki Okui, Azumino (JP); Yoichiro Kondo, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/725,364

(22) Filed: Dec. 23, 2019

(65) Prior Publication Data

US 2020/0207077 A1 Jul. 2, 2020

(30) Foreign Application Priority Data

Dec. 26, 2018 (JP) ..... 2018-242738

(51) Int. Cl.
*B41J 2/00* (2006.01)
*B41J 2/045* (2006.01)

(52) U.S. Cl.
CPC ..... *B41J 2/04541* (2013.01); *B41J 2/04581* (2013.01)

(58) Field of Classification Search
CPC ..... B81B 7/02; B41J 2/04541; B41J 2/04581; B41J 2002/14491; B41J 2002/14419; B41J 2202/20; B41J 2/14233
See application file for complete search history.

(56) References Cited

U.S. PATENT DOCUMENTS 9,375,930 B2 * 6/2016 Matsumoto ..... B41J 2/161

FOREIGN PATENT DOCUMENTS

EP 3560717 * 10/2019 ..... B41J 2/14
JP 201899833 6/2018

OTHER PUBLICATIONS

Machine translation of JP 2018-099833, published on 0/2018 (Year: 2018).*

* cited by examiner

*Primary Examiner* — Huan H Tran
(74) *Attorney, Agent, or Firm* — Workman Nydegger

(57) ABSTRACT

There is provided a liquid ejecting head including a plurality of drive elements for ejecting liquids from nozzles, respectively, a base portion, and a wiring formed on the base portion to drive the plurality of drive elements, in which the wiring includes a first wiring portion formed along an array of the plurality of drive elements, and a second wiring portion forming an annular path with respect to the first wiring portion.

11 Claims, 13 Drawing Sheets

LIQUID EJECTING HEAD, LIQUID EJECTING UNIT, LIQUID EJECTING APPARATUS, AND PIEZOELECTRIC DEVICE

The present application is based on, and claims priority from JP Application Serial Number 2018-242738, filed Dec. 26, 2018, the disclosure of which is hereby incorporated by reference herein in its entirety.

BACKGROUND

1. Technical Field

The present disclosure relates to a liquid ejecting head, a liquid ejecting unit, a liquid ejecting apparatus, and a piezoelectric device.

2. Related Art

A liquid ejecting head that ejects a liquid such as ink from a plurality of nozzles has been proposed conventionally. For example, JP-A-2018-99833 discloses a liquid ejecting head including a sealing plate on which wiring for supplying, to a driving IC, a drive signal for driving a plurality of piezoelectric elements is formed.

SUMMARY

For example, a wiring for supplying a drive signal is formed linearly along an array of a plurality of piezoelectric elements. Therefore, a voltage drop due to a resistance component of the wiring becomes a problem.

According to an aspect of the present disclosure, there is provided a liquid ejecting head including a plurality of drive elements for ejecting liquids from nozzles, respectively, a base portion, and a wiring formed on the base portion to drive the plurality of drive elements, in which the wiring includes a first wiring portion formed along an array of the plurality of drive elements, and a second wiring portion forming an annular path with respect to the first wiring portion.

According to another aspect of the present disclosure, there is provided a liquid ejecting unit in which a plurality of liquid ejecting heads each including a first nozzle group including a plurality of nozzles that eject a first liquid and a second nozzle group including a plurality of nozzles that eject a second liquid are arranged in a first direction, in which the plurality of liquid ejecting heads are arranged in the first direction such that the nozzles are arranged along a second direction inclined with respect to the first direction, ranges of the first nozzle groups in the first direction partially overlap each other over the plurality of liquid ejecting heads, and ranges of the second nozzle groups in the second direction overlap each other over the plurality of liquid ejecting heads, each of the plurality of liquid ejecting heads includes a plurality of drive elements that eject liquids from the nozzles, respectively, a base portion, and a wiring formed on the base portion to drive the plurality of drive elements, the wiring includes a first wiring portion formed along an array of the plurality of drive elements, and a second wiring portion forming an annular path with respect to the first wiring portion, and the second wiring portion includes a first portion that is formed along the array of the plurality of drive elements, a second portion that is formed on one side when viewed from the array in a direction in which the plurality of drive elements are arranged and connects the first wiring portion and the first portion, a third portion that is formed on the other side when viewed from the array in a direction in which the plurality of drive elements are arranged and connects the first wiring portion and the first portion, and a fourth portion that is formed at a position corresponding to a boundary between the first nozzle group and the second nozzle group in the direction in which the plurality of drive elements are arranged and connects the first wiring portion and the first portion.

According to still another aspect of the present disclosure, there is provided a liquid ejecting apparatus including the above-described liquid ejecting head and a control unit that controls the liquid ejecting head. Further, there is provided a liquid ejecting apparatus according to another aspect of the present disclosure including the above-described liquid ejecting unit and a control unit that controls the liquid ejecting unit.

According to still another aspect of the present disclosure, there is provided a piezoelectric device including a plurality of piezoelectric elements that eject liquids from nozzles, respectively, a base portion, and a wiring formed in the base portion to drive the plurality of piezoelectric elements, in which the wiring includes a first wiring portion formed along an array of the plurality of piezoelectric elements, and a second wiring portion forming an annular path with respect to the first wiring portion.

DESCRIPTION OF EXEMPLARY EMBODIMENTS

First Embodiment

Figure 1:
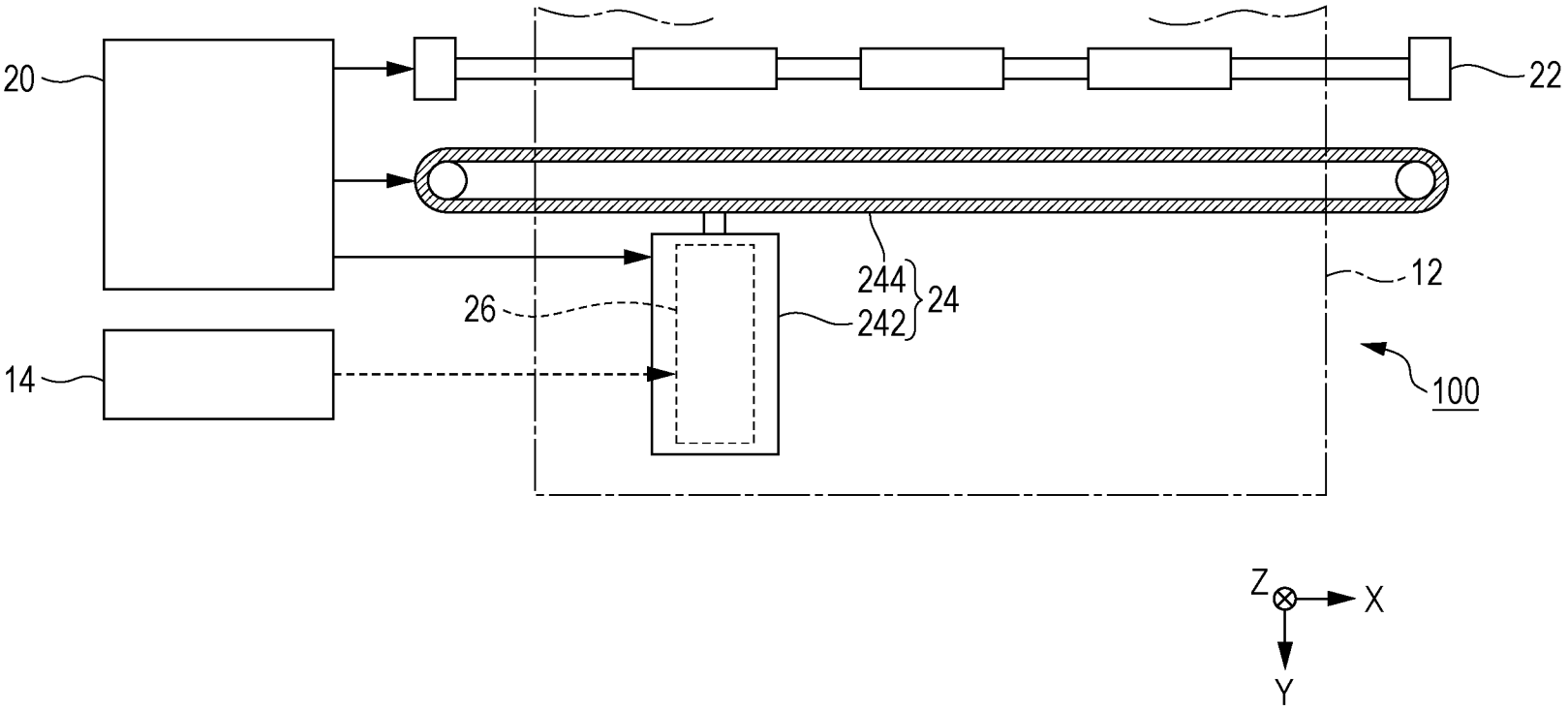
FIG. 1 is a block diagram illustrating a configuration of a liquid ejecting apparatus according to a first embodiment of the present disclosure.

FIG. 1 is a configuration diagram illustrating a liquid ejecting apparatus 100 according to a first embodiment of the present disclosure. The liquid ejecting apparatus 100 according to the first embodiment is an ink jet printing apparatus that ejects ink, which is an example of a liquid, onto a medium 12. Although the medium 12 is typically a printing paper sheet, a printing target made of a predetermined material such as a resin film and a fabric is used as the medium 12. As illustrated in FIG. 1, the liquid ejecting apparatus 100 is provided with a liquid container 14 that stores the ink. For example, a cartridge which can be attached to and detached from the liquid ejecting apparatus 100, a bag-like ink pack formed of a flexible film, or an ink tank which can be refilled with the ink is used as the liquid container 14. A plurality of types of inks having different colors are stored in the liquid container 14.

As illustrated in FIG. 1, the liquid ejecting apparatus 100 includes a control unit 20, a transport mechanism 22, a movement mechanism 24, and a liquid ejecting head 26. The control unit 20 is an example of a controller. In detail, the control unit 20 includes a processing circuit such as a central processing unit (CPU) and a field programmable gate array (FPGA) and a storage circuit such as a semiconductor memory, and integrally controls each component of the liquid ejecting apparatus 100. The transport mechanism 22 transports the medium 12 in a Y direction under a control of the control unit 20.

The movement mechanism 24 causes the liquid ejecting head 26 to reciprocate in an X direction under the control of the control unit 20. The X direction is a direction that intersects the Y direction in which the medium 12 is transported. Typically, a direction perpendicular to the Y direction is the X direction. The movement mechanism 24 of the first embodiment includes a substantially box-shaped transport body 242 that accommodates the liquid ejecting head 26 and a transport belt 244 to which the transport body 242 is fixed. A configuration in which a plurality of the liquid ejecting heads 26 are mounted on the transport body 242 and a configuration in which the liquid container 14 together with the liquid ejecting head 26 is mounted on the transport body 242 may be adopted.

The liquid ejecting head 26 ejects the ink supplied from the liquid container 14 to the medium 12 from a plurality of nozzles under the control of the control unit 20. The liquid ejecting head 26 ejects the ink to the medium 12 together with the transportation of the medium 12 by the transport mechanism 22 and the repeated reciprocation of the transport body 242, so that a desired image is formed on the surface of the medium 12. Hereinafter, a direction perpendicular to the X-Y plane is referred to as a Z direction. A direction in which the ink is ejected by the liquid ejecting head 26 corresponds to the Z direction. The Z direction is typically a vertical direction.

Figure 2:
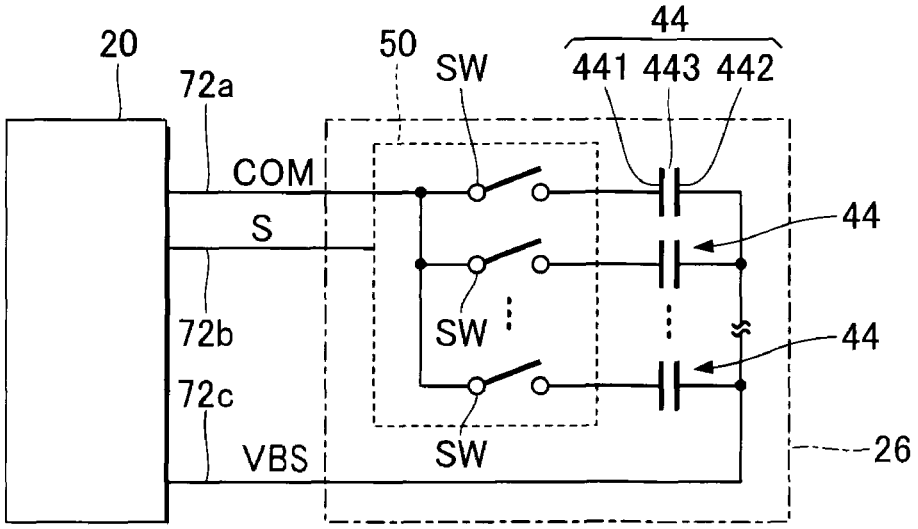
FIG. 2 is a block diagram illustrating a functional configuration of the liquid ejecting apparatus.
Figure 3:
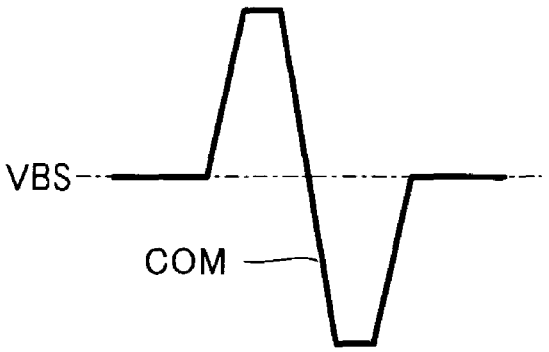
FIG. 3 is a diagram illustrating a waveform of a drive signal.

FIG. 2 is a block diagram illustrating a functional configuration of the liquid ejecting apparatus 100. Illustration of the transport mechanism 22 and the movement mechanism 24 is omitted for convenience. As illustrated in FIG. 2, the control unit 20 of the first embodiment supplies a control signal S, a drive signal COM, and a reference voltage VBS to the liquid ejecting head 26. The control signal S is a signal that indicates the presence and absence of the ejection of the ink and the ejection amount of the ink in each of the plurality of nozzles. The drive signal COM is a voltage signal that temporally fluctuates during a predetermined period with reference to the reference voltage VBS that is a constant voltage, and is used to eject the ink to the liquid ejecting head 26. As illustrated in FIG. 3, the drive signal COM is a voltage signal including a drive pulse at each predetermined period. The drive signal COM having a waveform including a plurality of drive pulses may be used.

As illustrated in FIG. 2, the liquid ejecting head 26 of the first embodiment includes a plurality of piezoelectric elements 44 corresponding to the plurality of nozzles, respectively, and a drive circuit 50 that drives each of the plurality of piezoelectric elements 44. In detail, the drive circuit 50 controls supply of the drive signal COM to each of the plurality of piezoelectric elements 44. The drive circuit 50 of the first embodiment includes a plurality of switches SW corresponding to the plurality of piezoelectric elements 44, respectively. Each of the plurality of switches SW is configured by a transfer gate that switches supply/stop of the drive signal COM to the piezoelectric elements 44 according to the control signal S.

Figure 4:
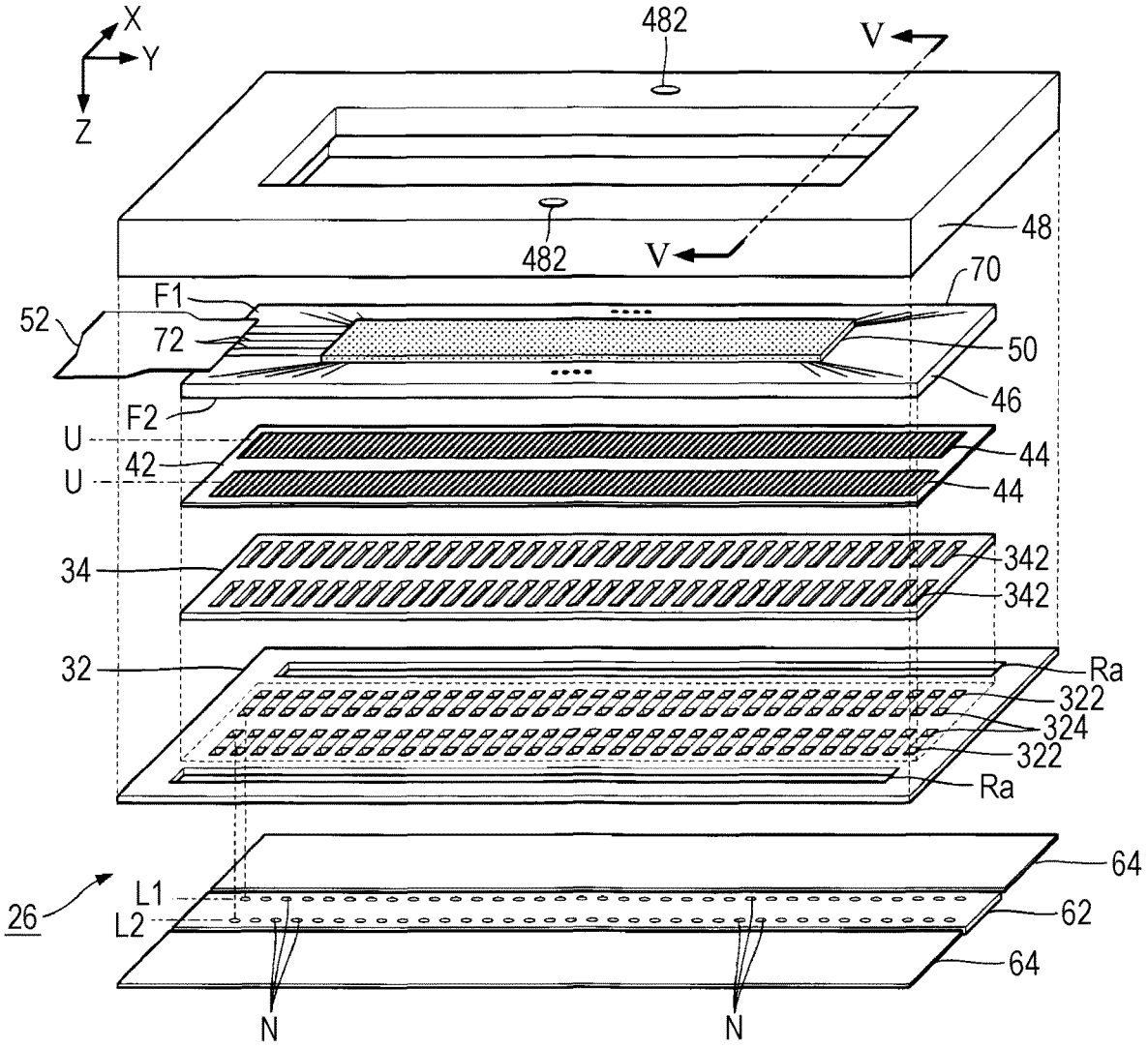
FIG. 4 is an exploded perspective view of a liquid ejecting head.
Figure 5:
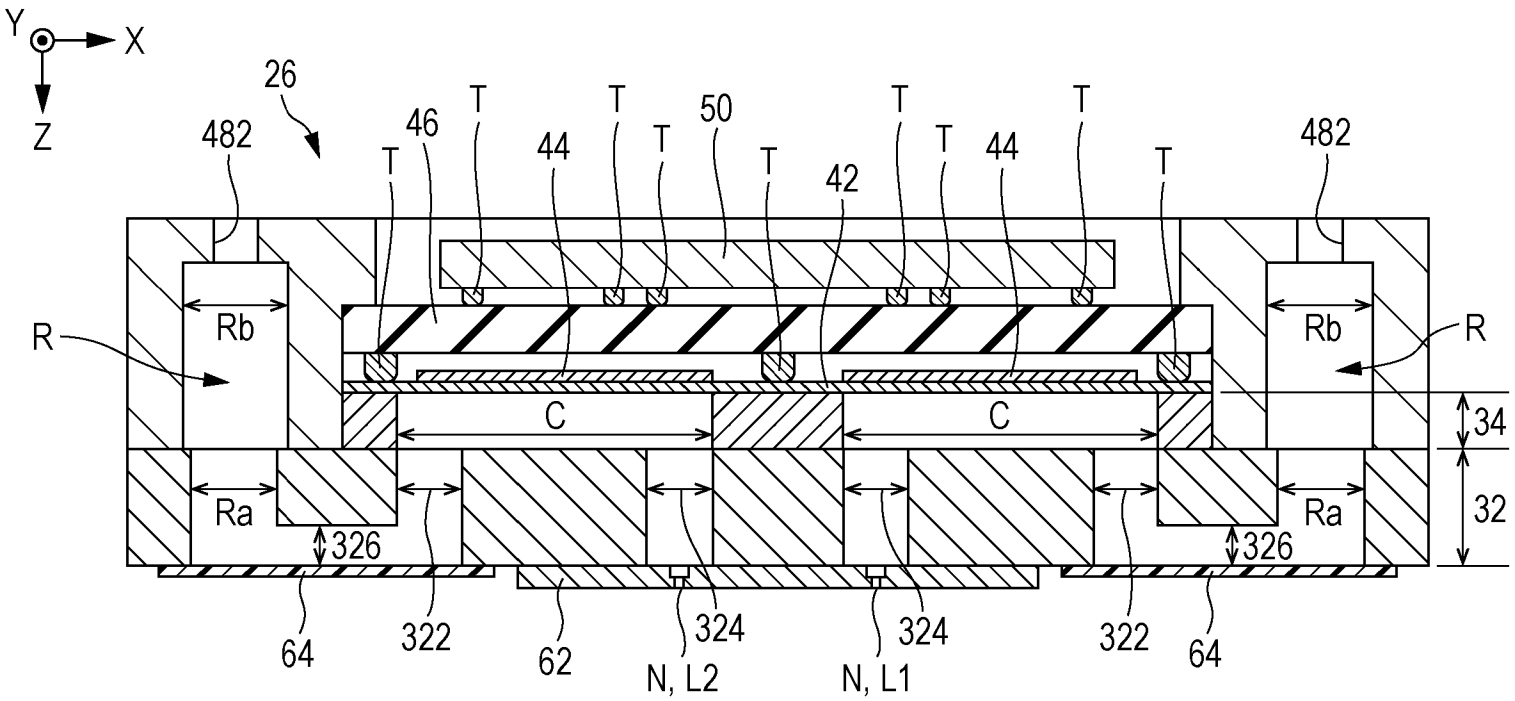
FIG. 5 is a cross-sectional view (a cross-sectional view taken along line V-V in FIG. 4) of the liquid ejecting head.

FIG. 4 is an exploded perspective view of the liquid ejecting head 26, and FIG. 5 is a cross-sectional view taken along line V-V in FIG. 4. As illustrated in FIG. 4, the liquid ejecting head 26 includes a plurality of nozzles N arranged in the Y direction. The plurality of nozzles N of the first embodiment are divided into a first row L1 and a second row L2 arranged in parallel to each other in the X direction at intervals. Each of the first row L1 and the second row L2 is a set of the plurality of nozzles N linearly arranged in the Y direction. Although the positions of the nozzles N in the Y direction may be different between the first row L1 and the second row L2, a configuration in which the positions of the nozzles N in the Y direction coincide with each other in the first row L1 and the second row L2 will be exemplified below for convenience. As understood from FIG. 5, the liquid ejecting head 26 of the first embodiment has a structure in which elements related to the nozzles N in the first row L1 and elements related to the nozzles N in the second row L2 are arranged substantially in plane-symmetric to each other.

As illustrated in FIGS. 4 and 5, the liquid ejecting head 26 includes a flow channel substrate 32. As illustrated in FIG. 4, a pressure chamber substrate 34, a diaphragm 42, a wiring substrate 46, a housing portion 48, and the drive circuit 50 are installed on a negative side of the flow channel substrate 32 in the Z direction. On the other hand, a nozzle plate 62 and a vibration absorber 64 are installed on a positive side of the flow channel substrate 32 in the Z direction. The elements of the liquid ejecting head 26 are plate-like members that are schematically long in the Y direction, and are bonded to each other using, for example, an adhesive. A combination of the piezoelectric element 44 and the wiring substrate 46 corresponds to a "piezoelectric device". A combination of the diaphragm 42, the piezoelectric element 44, and the wiring substrate 46 may be expressed as a "piezoelectric device".

The nozzle plate 62 is a plate-like member on which the plurality of nozzles N are formed, and is installed on a positive surface of the flow channel substrate 32 in the Z direction. Each of the plurality of nozzles N is a circular through-hole through which the ink passes. The plurality of nozzles N constituting the first row L1 and the plurality of nozzles N constituting the second row L2 are formed on the nozzle plate 62 of the first embodiment. For example, the nozzle plate 62 is manufactured by processing a silicon single crystal substrate using a semiconductor manufacturing technology such as dry etching and wet etching. However, widely-known materials and manufacturing methods can be adopted for manufacturing the nozzle plate 62, in a predetermined manner.

As illustrated in FIGS. 4 and 5, in the flow channel substrate 32, a space Ra, a plurality of supply flow channels 322, a plurality of communication flow channels 324, and a supply liquid chamber 326 are formed in each of the first row L1 and the second row L2. The space Ra is an opening formed in a long shape along the Y direction in plan view from the Z direction, and the supply flow channels 322 and the communication flow channels 324 are through-holes formed in each nozzle N. The supply liquid chamber 326 is a space formed in a long shape along the Y direction across the plurality of nozzles N, and causes the space Ra and the plurality of supply flow channels 322 to communicate with each other. Each of the plurality of communication flow channels 324 overlaps one nozzle N corresponding to the corresponding communication flow channel 324 in plan view.

As illustrated in FIGS. 4 and 5, the pressure chamber substrate 34 is a plate-like member in which a plurality of pressure chambers C are formed in each of the first row L1 and the second row L2. The plurality of pressure chambers C are arranged in the Y direction. Each pressure chamber C is a long space which is formed in each nozzle N and extends in the X direction in plan view. Similar to the above-described nozzle plate 62, the flow channel substrate 32 and the pressure chamber substrate 34 are manufactured by processing a silicon single crystal substrate using, for example, the semiconductor manufacturing technology. However, widely-known materials and manufacturing methods may be adopted for manufacturing the flow channel substrate 32 and the pressure chamber substrate 34, in a predetermined manner.

As illustrated in FIG. 4, the diaphragm 42 is formed on the surface of the pressure chamber substrate 34, which is opposite to the flow channel substrate 32. The diaphragm 42 of the first embodiment is a plate-like member which can vibrate elastically. By selectively removing a part of, in a plate thickness direction, an area corresponding to the pressure chamber C among the plate-like member having a predetermined plate thickness, a part or the entirety of the diaphragm 42 may be formed integrally with the pressure chamber substrate 34.

As understood from FIG. 4, the pressure chamber C is a space located between the flow channel substrate 32 and the diaphragm 42. A plurality of the pressure chambers C are arranged in the Y direction in each of the first row L1 and the second row L2. As illustrated in FIGS. 4 and 5, the pressure chamber C communicates with the communication flow channel 324 and the supply flow channel 322. Therefore, the pressure chamber C communicates with the nozzle N through the communication flow channel 324 and also communicates with the space Ra through the supply flow channel 322 and the supply liquid chamber 326.

As illustrated in FIGS. 4 and 5, the plurality of piezoelectric elements 44 corresponding to the different nozzles N in each of the first row L1 and the second row L2 are formed on the surface of the diaphragm 42, which is opposite to the pressure chamber C. The piezoelectric element 44 is a drive element that ejects the ink from the nozzle N by changing the pressure of the pressure chamber C. The piezoelectric element 44 is an example of a drive element. In detail, the piezoelectric element 44 is an actuator that is deformed by the supply of the drive signal COM, and is formed in a long shape along the X direction in plan view. The plurality of piezoelectric elements 44 are arranged in the Y direction to correspond to the plurality of pressure chambers C, respectively. That is, an array U of the plurality of piezoelectric elements 44 is formed in each of the first low L1 and the second row L2. In other words, the Y direction is a direction in which the plurality of piezoelectric elements 44 are arranged. When the diaphragm 42 vibrates in conjunction with the deformation of the piezoelectric elements 44, the pressure of the pressure chamber C fluctuates, so that the ink filled in the pressure chamber C passes through the communication flow channel 324 and the nozzle N and is ejected.

Figure 6:
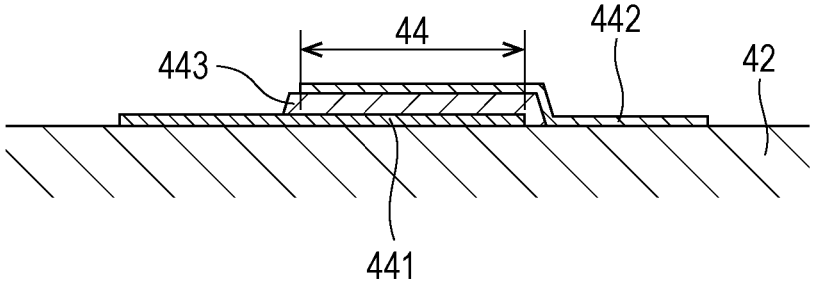
FIG. 6 is a sectional view illustrating a configuration of a piezoelectric element.

FIG. 6 is a sectional view of the piezoelectric element 44. As illustrated in FIG. 6, the piezoelectric element 44 is a laminated body in which a piezoelectric layer 443 is interposed between a first electrode 441 and a second electrode 442 facing each other. The first electrode 441 is an individual electrode formed on each piezoelectric element 44 on the surface of the diaphragm 42. The drive signal COM for each piezoelectric element 44 is supplied to the first electrode 441. The piezoelectric layer 443 is formed of, for example, a ferroelectric piezoelectric material such as lead zirconate titanate. The second electrode 442 is a common electrode that is continuous across the plurality of piezoelectric elements 44. A predetermined reference voltage VBS is applied to the second electrode 442. That is, a voltage corresponding to a difference between the reference voltage VBS and the drive signal COM is applied to the piezoelectric layer 443. A portion where the first electrode 441, the second electrode 442, and the piezoelectric layer 443 overlap each other in plan view functions as the piezoelectric element 44. When the diaphragm 42 vibrates in conjunction with the deformation of the piezoelectric elements 44, the pressure of the ink in the pressure chamber C fluctuates, so that the ink filled in the pressure chamber C passes through the communication flow channel 324 and the nozzle N and is ejected to the outside. A configuration in which the first electrode 441 serves as a common electrode and the second electrode 442 serves as an individual electrode of each piezoelectric element 44 or a configuration in which both the first electrode 441 and the second electrode 442 serve as individual electrodes may be adopted.

The housing portion 48 is a case for storing ink supplied to the plurality of pressure chambers C. As illustrated in FIG. 5, a space Rb is formed in each of the first row L1 and the second row L2 in the housing portion 48 of the first embodiment. The space Rb of the housing portion 48 and the space Ra of the flow channel substrate 32 communicate with each other. A space configured with the space Ra and the space Rb functions as a liquid storage chamber R that stores ink supplied to the plurality of pressure chambers C. The ink is supplied to the liquid storage chamber R through an inlet 482 formed in the housing portion 48. The ink in the liquid storage chamber R is supplied to the pressure chamber C through the supply liquid chamber 326 and each supply flow channel 322. The vibration absorber 64 is a flexible film that forms a wall surface of the liquid storage chamber R, and absorbs pressure fluctuations of the ink in the liquid storage chamber R.

The wiring substrate 46 of FIG. 4 is a plate-like member that faces the surface of the diaphragm 42, on which the plurality of piezoelectric elements 44 are formed, at intervals. The wiring substrate 46 of the first embodiment functions as a reinforcement plate that reinforces the mechanical strength of the liquid ejecting head 26 and also a sealing plate that protects and seals the piezoelectric element 44. The wiring substrate 46 is electrically coupled to the control unit 20 via an external wiring 52. The external wiring 52 is a flexible wiring substrate for supplying a voltage and a signal generated by the control unit 20 to the wiring substrate 46 from the control unit 20. For example, a connection component such as a flexible printed circuit (FPC) and a flexible flat cable (FFC) is suitably adopted as the external wiring 52.

The housing portion 48 is a case for storing the ink supplied to the plurality of pressure chambers C (further, the plurality of nozzles N). As illustrated in FIG. 5, a space Rb is formed in each of the first row L1 and the second row L2 in the housing portion 48 of the first embodiment. The space Rb of the housing portion 48 and the space Ra of the flow channel substrate 32 communicate with each other. A space configured with the space Ra and the space Rb functions as a liquid storage chamber (a reservoir) R that stores ink supplied to the plurality of pressure chambers C. The ink is supplied to the liquid storage chamber R through an inlet 482 formed in the housing portion 48. The ink in the liquid storage chamber R is supplied to the pressure chamber C through the supply liquid chamber 326 and each supply flow channel 322. The vibration absorber 64 is a flexible film (a compliance board) constituting a wall surface of the liquid storage chamber R, and absorbs pressure fluctuations of the ink in the liquid storage chamber R.

The wiring substrate 46 includes a base portion 70 and a plurality of wirings 72. The base portion 70 is an insulating plate-like member that is long in the Y direction, and is located between a flow channel forming portion 30 and the drive circuit 50. The base portion 70 is manufactured by processing a silicon single crystal substrate using, for example, the semiconductor manufacturing technology. However, widely-known materials and manufacturing methods can be adopted for manufacturing the base portion 70, in a predetermined manner.

As illustrated in FIG. 4, the base portion 70 is a plate-like member including a first surface F1 and a second surface F2 located opposite to each other. The base portion 70 is fixed to the surface of the pressure chamber substrate 34 (or the diaphragm 42), which is opposite to the flow channel substrate 32 using, for example, an adhesive. In detail, the base portion 70 is installed such that the second surface F2 faces the surface of the diaphragm 42 at intervals. As illustrated in FIG. 4, the drive circuit 50 and the external wiring 52 are mounted on the first surface F1 of the base portion 70. The drive circuit 50 is an IC chip that is long along a longitudinal direction of the base portion 70. The external wiring 52 is mounted on a negative end portion of the first surface F1 of the base portion 70 in the Y direction.

A plurality of wirings 72 for driving the plurality of piezoelectric elements 44 are formed on the first surface F1 and the second surface F2 of the base portion 70. In detail, as illustrated in FIG. 2, a wiring 72*a* to which the drive signal COM is supplied, a wiring 72*b* to which the control signal S is supplied, and a wiring 72*c* to which the reference voltage VBS is supplied are formed in the base portion 70. The drive signal COM is supplied to the drive circuit 50 through the wiring 72*a*, and the control signal S is supplied to the drive circuit 50 through the wiring 72*b*. On the other hand, the reference voltage VBS is supplied to the second electrodes 442 of the plurality of piezoelectric elements 44 through the wiring 72*c* without passing through the drive circuit 50.

Figure 7:
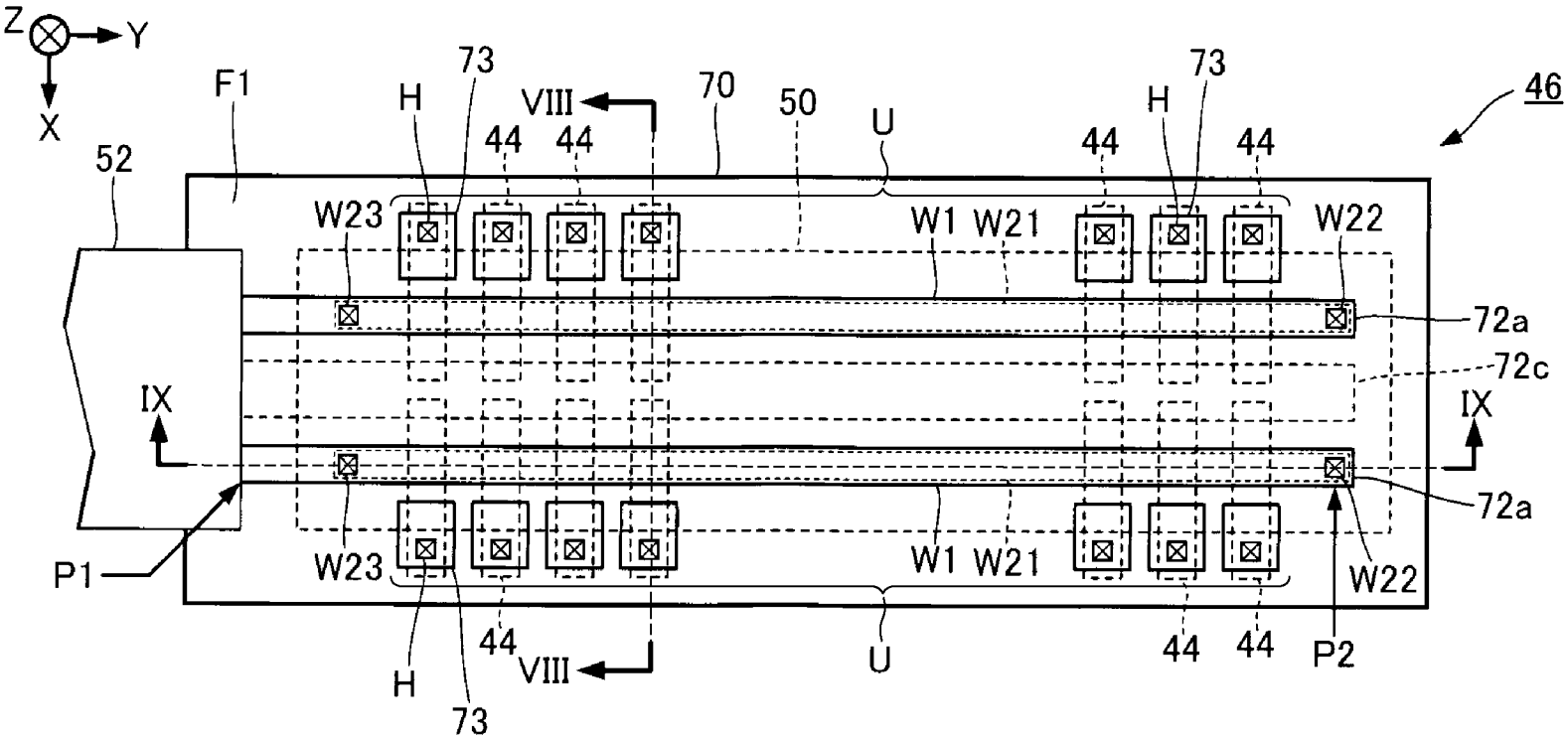
FIG. 7 is a plan view of a wiring substrate.
Figure 8:
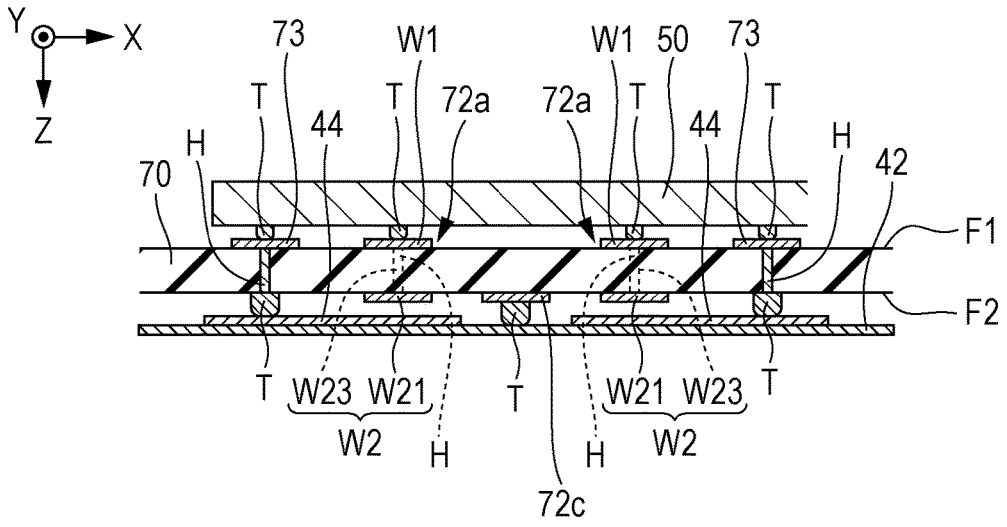
FIG. 8 is a cross-sectional view (a cross-sectional view taken along line VIII-VIII in FIG. 7) of the wiring substrate.
Figure 9:
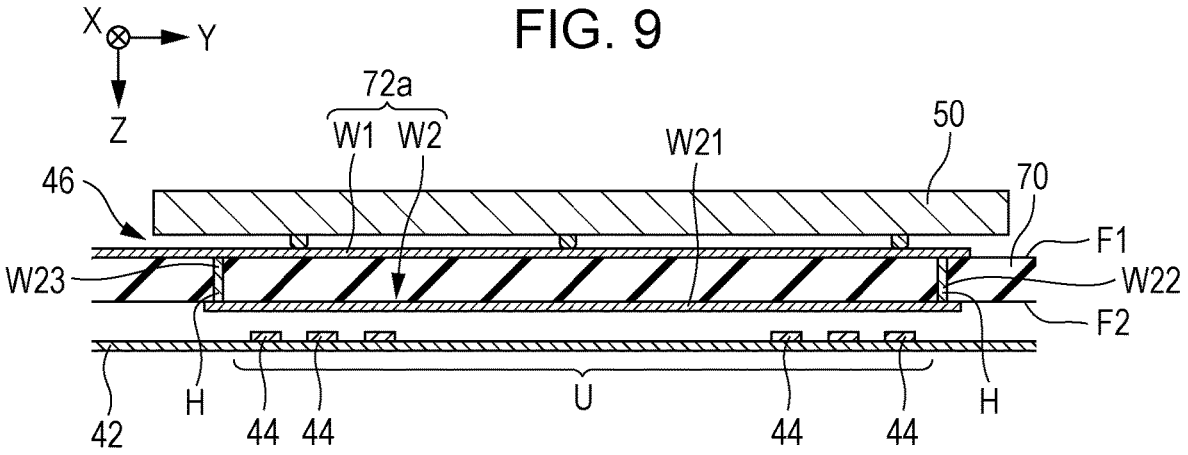
FIG. 9 is a sectional view (a sectional view taken along line IX-IX in FIG. 7) of the wiring substrate.

FIG. 7 is a plan view of the wiring substrate 46 when viewed from the positive side in the Z direction, FIG. 8 is a cross-sectional view taken along line VIII-VIII in FIG. 7, and FIG. 9 is a sectional view taken along line IX-IX in FIG. 7. The wiring 72*b* and other wirings formed in the base portion 70 are not illustrated for convenience. As illustrated in FIGS. 7 to 9, the wiring 72*a*, which is an annular wiring, is formed in each of the array U corresponding to the first row L1 and the array U corresponding to the second row L2.

The wiring 72*a* includes a first wiring portion W1 and a second wiring portion W2. The first wiring portion W1 is formed on the first surface F1 of the base portion 70 along the array U of the plurality of piezoelectric elements 44. That is, the first wiring portion W1 is formed linearly along the Y direction. In the first embodiment, the first wiring portion W1 is formed over the entire array U. In detail, the first wiring portion W1 is formed from the external wiring 52 toward the periphery of the base portion 70, which is opposite to the external wiring 52. An end portion of the first wiring portion W1, which is opposite to the external wiring 52, is located on the positive side in the Y direction with respect to the piezoelectric element 44 located at a positive end portion of the array U in the Y direction when viewed from the Z direction.

As illustrated in FIG. 9, the second wiring portion W2 forms an annular path with respect to the first wiring portion W1. The first wiring portion W1 of the first embodiment includes a first portion W21, a second portion W22, and a third portion W23. As illustrated in FIGS. 7 and 9, the first portion W21 is a portion of the second wiring portion W2, which is formed along the array U on the second surface F2 of the base portion 70. That is, the first portion W21 is linearly formed along the Y direction. In detail, the first portion W21 is formed on the second surface F2 of the base portion 70 to be opposite to the first wiring portion W1 with the base portion 70 interposed therebetween. An end portion of the first portion W21 on the external wiring 52 side is located on the negative side in the Y direction with respect to the piezoelectric element 44 located at a negative end of the array U in the Y direction. An end portion of the first portion W21, which is opposite to the external wiring 52, is located on the positive side in the Y direction with respect to the piezoelectric element 44 located at a positive end of the array U in the Y direction.

As illustrated in FIGS. 7 and 9, the second portion W22 and the third portion W23 are portions which connect the first wiring portion W1 and the first portion W21 in the second wiring portion W2. That is, the first wiring portion W1 and the first portion W21 are electrically connected to each other by the second portion W22 and the third portion W23. The second portion W22 and the third portion W23 in the first embodiment are penetration electrodes that penetrate the base portion 70. The second portion W22 and the third portion W23 are formed inside a through-hole H formed in the base portion 70 along the Z direction. The second portion W22 extends from a positive end portion of the first portion W21 in the Y direction toward the first wiring portion W1. Meanwhile, the third portion W23 extends from a negative end portion of the first portion W21 in the Y direction toward the first wiring portion W1. That is, in the Y direction, the second portion W22 is located on one side when viewed from the array U, and the third portion W23 is located on the other side when viewed from the array U. That is, in plan view from the Z direction, the second portion W22 is located on the positive side in the Y direction with respect to the piezoelectric element 44 located at the positive end portion of the array U in the Y direction, and the third portion W23 is located on the negative side in the Y direction with respect to the piezoelectric element 44 located at the negative end portion of the array U in the Y direction.

As illustrated in FIGS. 8 and 9, the wirings 72*a* are electrically coupled to the drive circuit 50 through a plurality of connection terminals T formed on the surface of the drive circuit 50 on the wiring substrate 46 side. In detail, the connection terminals T of the drive circuit 50 are in contact with the surface of the first wiring portion W1. The drive circuit 50 is in electric contact with each piezoelectric element 44 through a relay wiring 73 formed in the base portion 70. As illustrated in FIGS. 7 and 8, the relay wiring 73 is formed on the first surface F1 of the base portion 70 for each piezoelectric element 44. The relay wiring 73 is electrically connected to the drive circuit 50 through the connection terminals T formed on the surface of the drive circuit 50. Further, the relay wiring 73 is electrically coupled to the connection terminal T formed on the second surface F2 of the base portion 70 through the penetration electrode formed inside the through-hole H of the base portion 70. The first electrode 441 of each piezoelectric element 44 is electrically coupled to the relay wiring 73 through the connection terminal T. Therefore, the drive signal COM supplied from the wiring 72*a* to the drive circuit 50 is supplied to the first electrode 441 of the piezoelectric element 44 through the relay wiring 73.

As illustrated in FIGS. 7 and 8, the wiring 72*c* is linearly formed on the second surface F2 of the base portion 70 along the Y direction. In detail, the wiring 72*c* is formed from the external wiring 52 toward the periphery of the base portion 70, which is opposite to the external wiring 52. For example, in plan view from the Z direction, the wiring 72*c* is formed between the first portion W21 corresponding to the first row L1 and the first portion W21 corresponding to the second row L2. An end portion of the wiring 72*c*, which is opposite to the external wiring 52, is located on the positive side in the Y direction with respect to the piezoelectric element 44 located at a positive end portion of the array U in the Y direction when viewed from the Z direction. As illustrated in FIG. 8, the wiring 72*c* is electrically coupled to the second electrode 442 of the piezoelectric element 44 through the connection terminal T. Therefore, the reference voltage VBS is commonly supplied to the second electrodes 442 through the wiring 72*c*.

Figure 10:
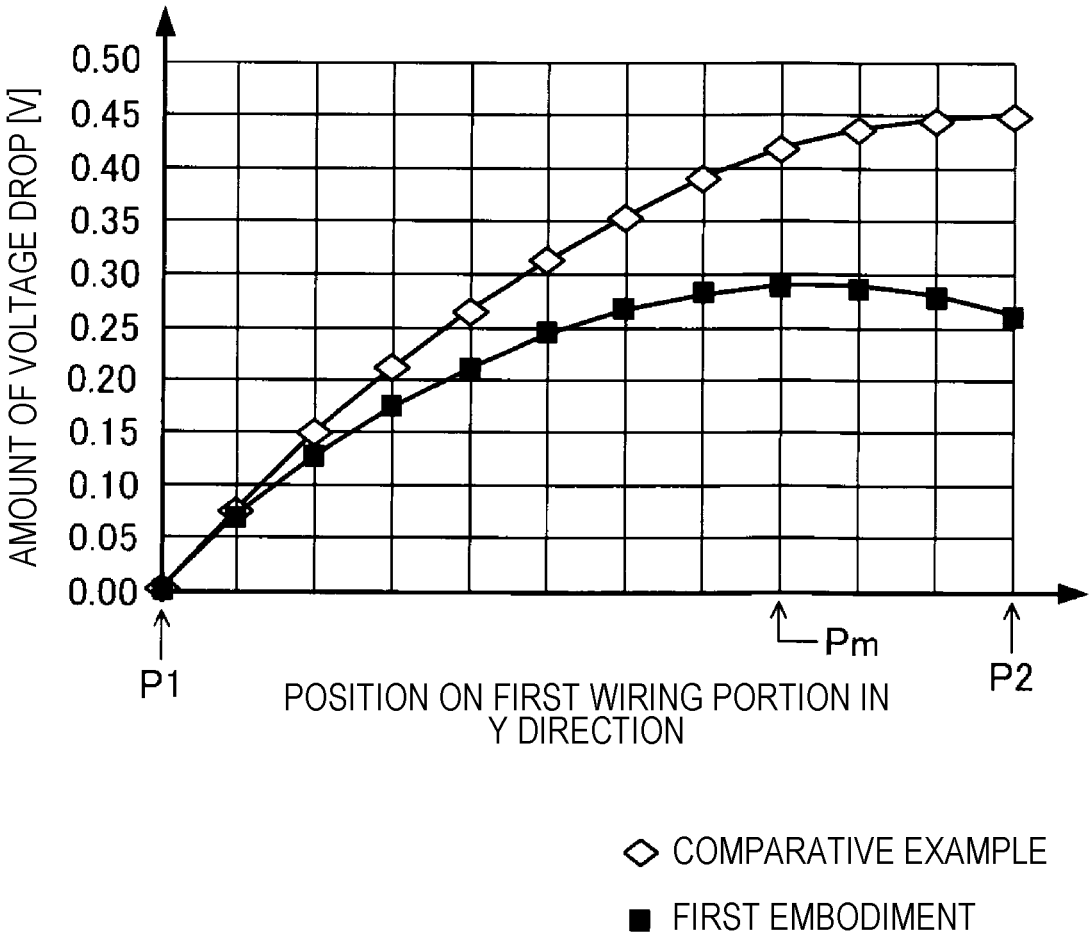
FIG. 10 is a graph depicting a relationship between a position of a first wiring portion and the amount of voltage drop at the corresponding position.

FIG. 10 is a graph depicting a relationship between a position on the first wiring portion W1 in the Y direction and a voltage drop at the position in each of a comparative example and the first embodiment. In the comparative example, the wiring 72*a* has not a ring shape but a straight line shape. That is, in the comparative example, the wiring 72*a* is configured with only the first wiring portion W1. As illustrated in FIG. 7, in FIG. 10, P1 on the horizontal axis is a connection position with the external wiring 52 in the first wiring portion W1, and P2 is a connection position with the second portion W22 in the first wiring portion W1.

As clearly understood from FIG. 10, according to the configuration of the first embodiment in which the wiring 72*a* has an annular shape, a voltage drop due to a resistance component of the wiring 72*a* is suppressed as compared to the comparative example. Therefore, a voltage difference according to the position on the wiring 72*a* in the Y direction is reduced. As a result, the voltage of the drive signal COM supplied from the wiring 72*a* via the drive circuit 50 to each piezoelectric element 44 becomes uniform in the plurality of piezoelectric elements 44. Therefore, it is possible to reduce an error in ejection characteristics between the plurality of nozzles N. The ejection characteristics are, for example, an ejection amount, an ejection direction, and an ejection speed.

In the first embodiment, in plan view, although the configuration in which the first wiring portion W1 and the first portion W21 of the second wiring portion W2 overlap each other has been illustrated, a configuration in which the first wiring portion W1 and the first portion W21 partially overlap each other or also a configuration in which the first wiring portion W1 and the first portion W21 do not overlap each other may be adopted.

Second Embodiment

A second embodiment of the present disclosure will be described. In the following examples, an element having the same function as that of the first embodiment is designated by the same reference numeral used in the description of the first embodiment, and detailed description thereof will be omitted as appropriate.

Figure 11:
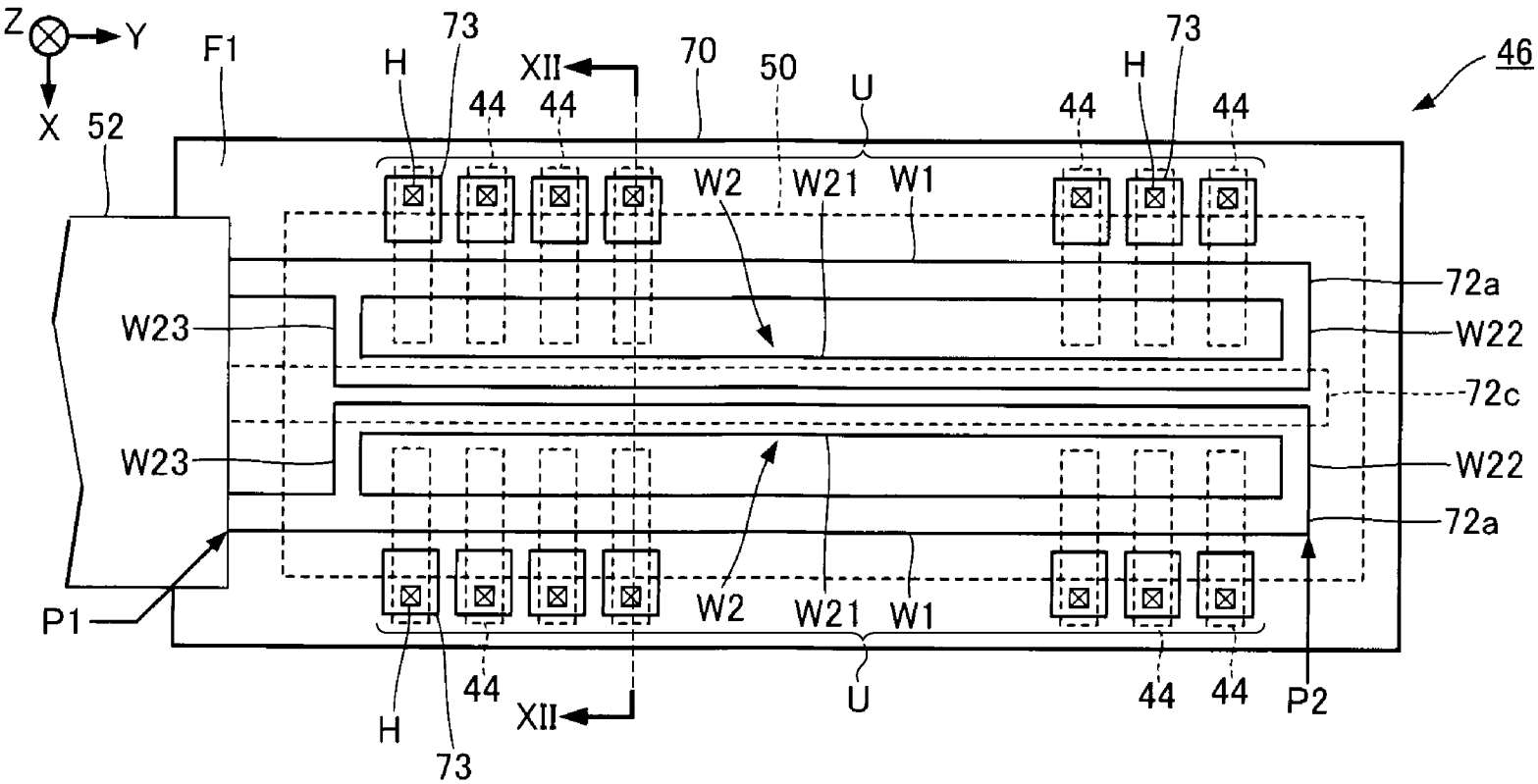
FIG. 11 is a plan view of the wiring substrate according to a second embodiment.
Figure 12:
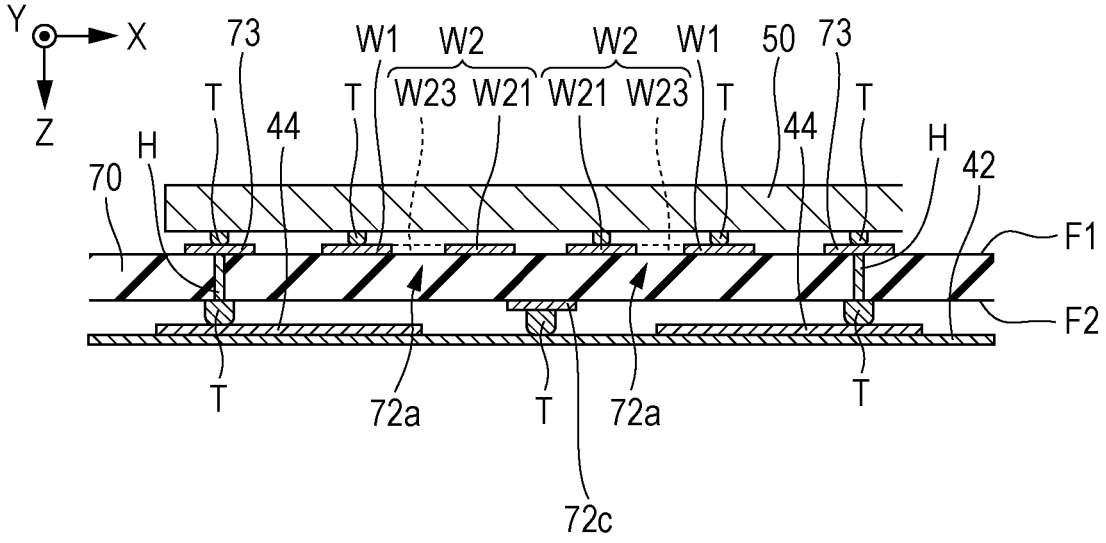
FIG. 12 is a cross-sectional view (a cross-sectional view taken along line XII-XII in FIG. 11) of the wiring substrate.

FIG. 11 is a plan view of the wiring substrate 46 according to the second embodiment, and FIG. 12 is a cross-sectional view taken along line XII-XII in FIG. 11. The wiring 72*a* of the second embodiment has an annular shape, which is like the first embodiment. However, in the first embodiment, the annular wiring 72*a* is formed across the first surface F1 and the second surface F2 through the base portion 70, whereas in the second embodiment, the annular wiring 72*a* is formed on the first surface F1 of the base portion 70.

As illustrated in FIGS. 11 and 12, the first wiring portion W1 of the wiring 72*a* is formed on the first surface F1 of the base portion 70, which is like the first embodiment. The second wiring portion W2 according to the second embodiment is formed on the first surface F1 of the base portion 70. That is, the first wiring portion W1 and the second wiring portion W2 are formed on the same surface of the base portion 70. In detail, similar to the first embodiment, the second wiring portion W2 forms an annular path with respect to the first wiring portion W1, and includes a first portion W21, a second portion W22, and a third portion W23. The first portion W21 is linearly formed on the first surface F1 along the array U of the plurality of piezoelectric elements 44. In detail, the first portion W21 is formed over the entire array U. The first portion W21 of the second embodiment is formed on an opposite side to the arrangement of a plurality of the relay wirings 73 when viewed from the first wiring portion W1.

As illustrated in FIG. 11, each of the second portion W22 and the third portion W23 connects the first wiring portion W1 and the first portion W21, which is like the first embodiment. Each of the second portion W22 and the third portion W23 of the second embodiment is formed on the first surface F1 along the X direction. Similar to the first embodiment, in the Y direction, the second portion W22 is located on one side when viewed from the array U, and the third portion W23 is located on the other side when viewed from the corresponding array U. That is, in plan view from the Z direction, the second portion W22 is located on the positive side in the Y direction with respect to the piezoelectric element 44 located at the positive end portion of the array U in the Y direction, and the third portion W23 is located on the negative side in the Y direction with respect to the piezoelectric element 44 located at the negative end portion of the array U in the Y direction.

In the second embodiment, the same effect as that of the first embodiment is realized. In the second embodiment, since the first wiring portion W1 and the second wiring portion W2 are formed on the first surface F1 of the base portion 70, it is easy to form the second wiring portion W2 and it is possible to reduce resistance in the second wiring portion W2, as compared to the configuration of the first embodiment in which the second wiring portion W2 is formed in the through-hole and the second surface F2 of the base portion 70. However, according to the configuration of the first embodiment, since the second wiring portion W2 is formed in the through-hole H and the second surface F2 of the base portion 70, the wiring substrate 46 can be downsized, as compared to the configuration of the second embodiment in which the first wiring portion W1 and the second wiring portion W2 are formed on the same surface of the base portion 70.

In the second embodiment, the first portion W21 is formed on an opposite side to the arrangement of the plurality of relay wirings 73 when viewed from the first wiring portion W1. However, the configuration of the second wiring portion W2 is not limited to the above-described example. For example, a configuration in which the first portion W21 is formed between the arrangement of the relay wirings 73 and the first wiring portion W1 or a configuration in which the first portion W21 is formed on an opposite side to the first wiring portion W1 when viewed from the relay wirings 73 is also adopted. Further, a configuration in which the first portion W21 is formed on a lateral surface of the base portion 70 is also adopted.

Third Embodiment

Figure 13:
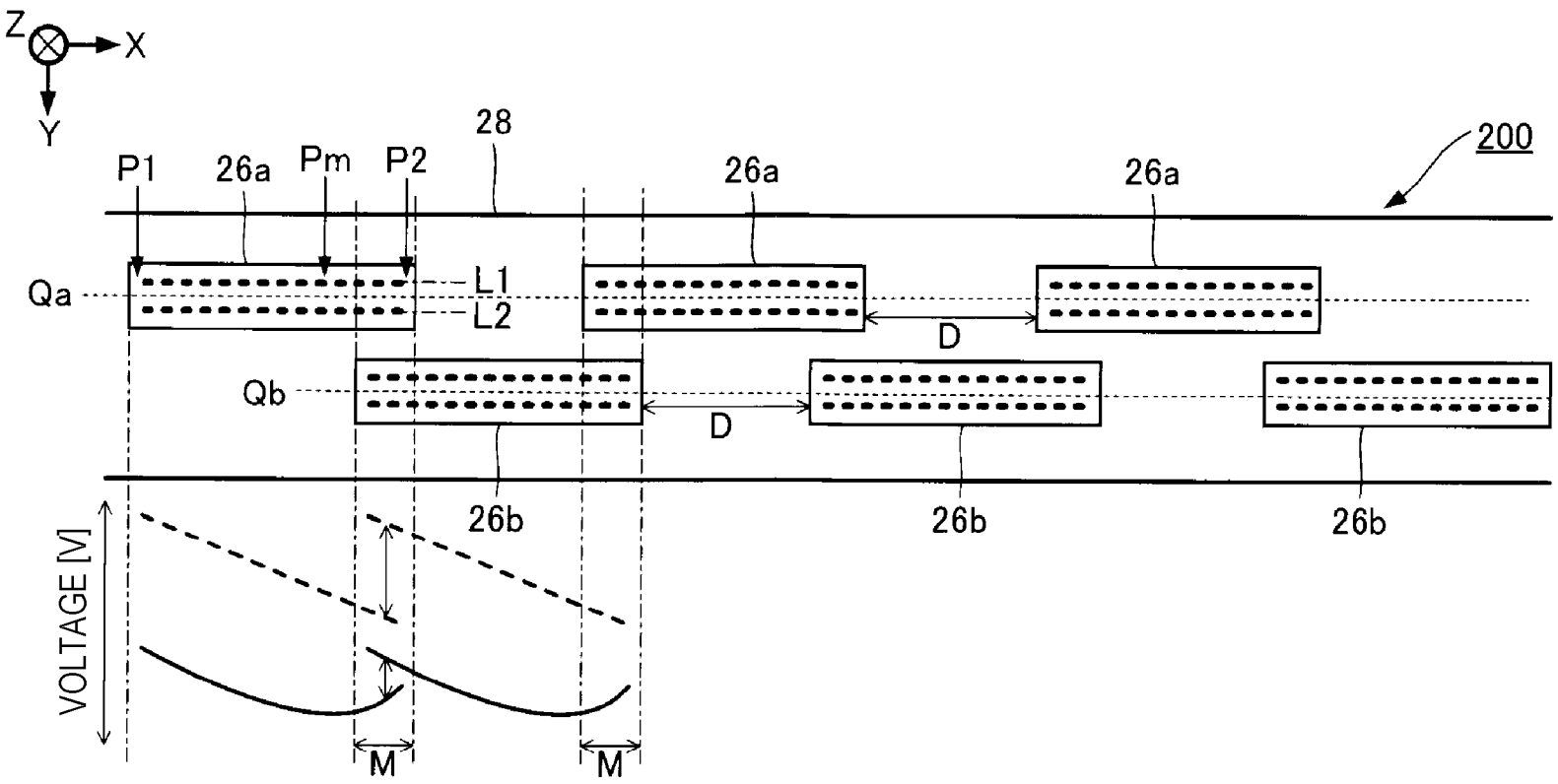
FIG. 13 is a plan view of a liquid ejecting unit according to a third embodiment.

FIG. 13 is a plan view of a liquid ejecting unit 200 according to a third embodiment. The liquid ejecting unit 200 according to the third embodiment is used in a line-type liquid ejecting apparatus in which the plurality of nozzles N are distributed over the entire width of the medium 12. As illustrated in FIG. 13, the liquid ejecting unit 200 includes a plurality of liquid ejecting heads 26 and a support 28 that supports the respective liquid ejecting heads 26. The configuration of each liquid ejecting head 26 is the same as that of the first embodiment.

The plurality of liquid ejecting heads 26 are arranged in a zigzag in plan view from the Z direction. The liquid ejecting head 26 is arranged such that the first row L1 and the second row L2 are along the X direction. In detail, an array Qa of a plurality of liquid ejecting heads 26*a* and an array Qb of a plurality of liquid ejecting heads 26*b* are arranged in parallel to each other with an interval therebetween in the Y direction. The array Qa includes the plurality of liquid ejecting heads 26*a* arranged in parallel to each other with a predetermined interval D therebetween along the X direction. On the other hand, the array Qb includes the plurality of liquid ejecting heads 26*b* arranged in parallel to each other at an interval D such that the positions of the liquid ejecting heads 26*b* in the X direction are different from those of the liquid ejecting heads 26*a*. The interval D is smaller than the length of the liquid ejecting head 26 in the X direction. As described above in the first embodiment, the first wiring portion W1 formed along the array U of the plurality of piezoelectric elements 44 is arranged in each of the first row L1 and the second row L2. In FIG. 13, a case where the first wiring portion W1 extends from a negative end portion of the liquid ejecting head 26 in the X direction is illustrated. That is, the connection position P1 of the first wiring portion W1 with the external wiring 52 is located at the negative end portion of the liquid ejecting head 26 in the X direction, and the connection position P2 of the first wiring portion W1 with the second portion W22 is located at a positive end portion of the liquid ejecting head 26 in the X direction. In the following description, when there is no need to particularly distinguish the array Qa and the array Qb from each other, the arrays Qa and Qb are simply expressed as an "array Q".

As illustrated in FIG. 13, the liquid ejecting head 26 in one array Q of the array Qa and the array Qb is located between two adjacent liquid ejecting heads 26 of the other array Q when viewed from the X direction, and the corresponding two adjacent liquid ejecting heads 26 partially overlap each other. As illustrated in FIG. 13, in an area where the plurality of liquid ejecting heads 26 are arranged, a range M where the liquid ejecting heads 26*a* of the array Qa and the liquid ejecting heads 26*b* of the array Qb in the X direction overlap each other is defined. In detail, the range M is a portion where the positive end portion of the liquid ejecting head 26 of the one array Q in the X direction and the negative end portion of the liquid ejecting head 26 of the other array Q in the X direction overlap each other in the X direction. In the range M, the plurality of nozzles N of the liquid ejecting heads 26*a* and the plurality of nozzles N of the liquid ejecting heads 26*b* overlap each other. Therefore, it is possible to form an image on the medium 12 without generating a joint in the X direction.

In FIG. 13, in the comparative example in which the wiring 72*a* has a linear shape, a state in which the voltage on the first wiring portion W1 is effective is illustrated by a broken line. In the third embodiment in which the wiring 72*a* has an annular shape, a state in which the voltage on the first wiring portion W1 is lowered is illustrated by a solid line. As understood from FIG. 13, according to the configuration of the third embodiment, a difference between the voltage supplied to the piezoelectric element 44 of the liquid ejecting head 26*a* and the voltage supplied to the piezoelectric element 44 of the liquid ejecting head 26*b* is reduced within the range M. As a result, in the range M, an error of the ejection characteristics between the liquid ejecting head 26*a* and the liquid ejecting head 26*b* is reduced.

As clearly understood from FIG. 10, in the comparative example, the amount of the voltage drop of the first wiring portion W1 of the liquid ejecting head 26 increases as the first wiring portion W1 becomes farther away from the connection position P1 with the external wiring 52. That is, the voltage supplied to the piezoelectric element 44 is minimized at the connection position P2 of the first wiring portion W1 with the second portion W22. On the other hand, in the third embodiment, in the first wiring portion W1 of the liquid ejecting head 26, as understood from FIG. 10, the voltage supplied to the piezoelectric element 44 is minimized at a point Pm between the connection position P1 and the connection position P2. In the third embodiment, as a configuration in which the liquid ejecting head 26 is arranged such that the point Pm in the first wiring portion W1 is located outside the range M is adopted, within the range M, an effect that a difference between the voltages supplied to the piezoelectric elements 44 is reduced in the liquid ejecting head 26*a* and the liquid ejecting head 26*b* becomes more remarkable.

Fourth Embodiment

The liquid ejecting unit 200 according to a fourth embodiment includes the plurality of liquid ejecting heads 26 arranged in the X direction and the support 28 that supports the plurality of liquid ejecting heads 26. The plurality of liquid ejecting heads 26 are arranged such that the nozzles N are arranged along a W direction inclined with respect to the X direction. As described above, as the liquid ejecting heads 26 are inclined with respect to the X direction, the resolution of the image formed on the medium 12 in the X direction can be improved. The X direction is an example of a first direction, and the W direction is an example of a second direction.

A liquid storage chamber R1 and a liquid storage chamber R2 for storing inks having different colors are formed inside the liquid ejecting head 26. The plurality of nozzles N of the liquid ejecting head 26 are divided into a first nozzle group G1 and a second nozzle group G2 along the W direction. Each nozzle N of the first nozzle group G1 ejects a first color ink supplied from the liquid storage chamber R1, and each nozzle N of the second nozzle group G2 ejects a second color ink supplied from the liquid storage chamber R2. A boundary B between the first nozzle group G1 and the second nozzle group G2 is located near a central portion of the liquid ejecting head 26 in the W direction. The first color ink is an example of a first liquid, and the second color ink is an example of a second liquid.

A range K in the X direction in which the first nozzle groups G1 of the liquid ejecting heads 26 are formed is formed such that the first nozzle groups G1 overlap each other over the plurality of liquid ejecting heads 26. Therefore, an image of each of a first color and a second color can be formed on the medium 12 without generating a joint in the X direction. The position of the boundary B in the X direction is the vicinity of a portion where two adjacent ranges K overlap each other in the X direction.

Figure 14:
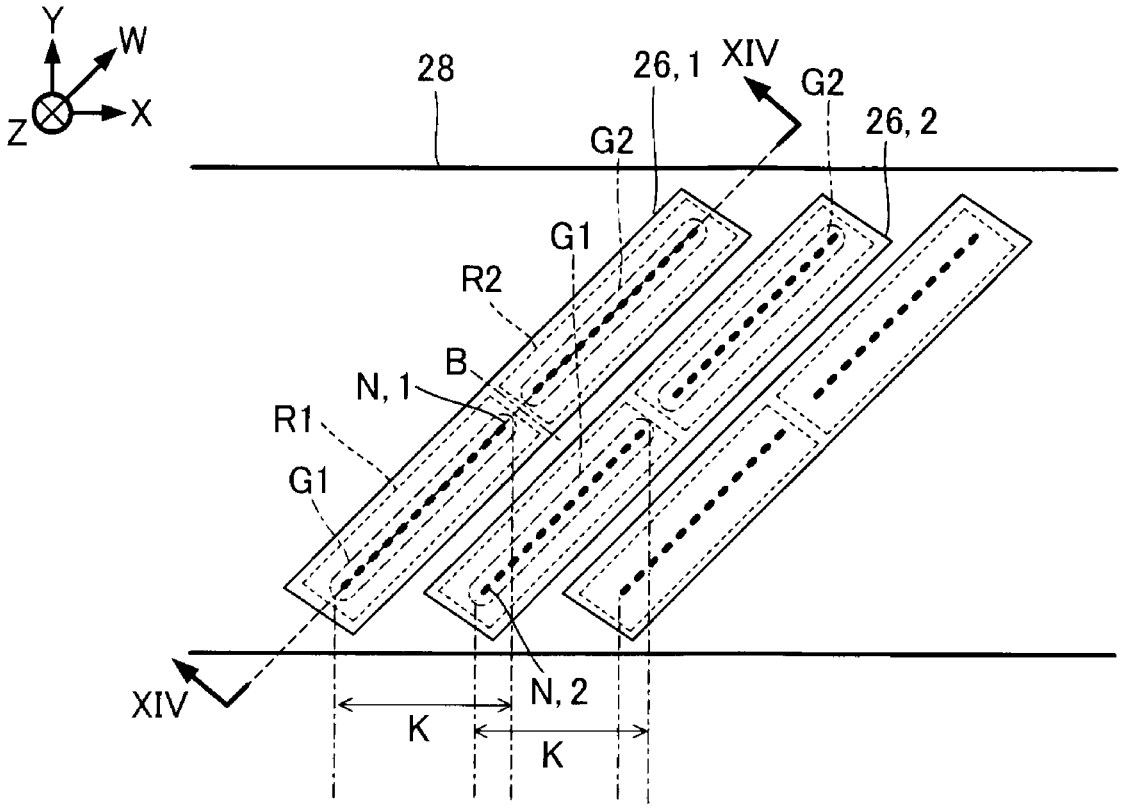
FIG. 14 is a plan view of a liquid ejecting unit according to a fourth embodiment.
Figure 15:
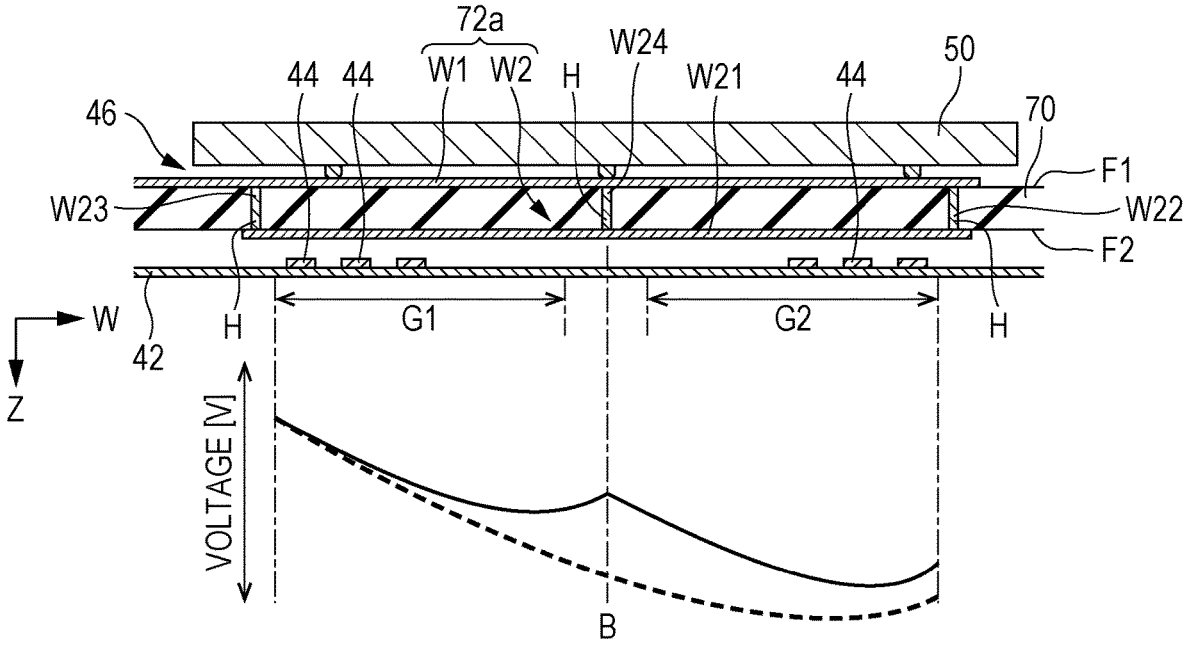
FIG. 15 is a sectional view (a sectional view taken along line XIV-XIV in FIG. 14) of the wiring substrate.

FIG. 14 is a sectional view of the wiring substrate 46 of the liquid ejecting head 26. FIG. 15 illustrates a cross-section corresponding to FIG. 9 in the first embodiment. However, in FIG. 15, a horizontal direction is the W direction.

Similar to the first embodiment, even in the fourth embodiment, the wiring 72*a* on the wiring substrate 46, through which the drive signal COM is transmitted, includes the first wiring portion W1 and the second wiring portion W2. As illustrated in FIG. 15, the wiring 72*a* extends over both the first nozzle group G1 and the second nozzle group G2. The second wiring portion W2 of the fourth embodiment includes a first portion W21 formed on the second surface F2 of the base portion 70, and a second portion W22, a third portion W23, and a fourth portion W24 that penetrate the base portion 70. That is, the wiring 72*a* of the fourth embodiment has a configuration obtained by adding the fourth portion W24 to the wiring 72*a* of the first embodiment. Similar to the first embodiment, the second portion W22 and the third portion W23 are located near the end portions of the first wiring portion W1 and the first portion W21.

The fourth portion W24 is located between the second portion W22 and the third portion W23. In detail, the fourth portion W24 is located at a central portion of the base portion 70 in the W direction. That is, the first wiring portion W1 and the first portion W21 are electrically connected to each other by the fourth portion W24 at a position corresponding to the boundary B between the first nozzle group G1 and the second nozzle group G2. The voltage drop on the first wiring portion W1 is suppressed by electrically connecting the first wiring portion W1 and the first portion W21 in the fourth portion W24 in addition to the electric connection between the second portion W22 and the third portion W23.

In FIG. 15, a state in which the voltage on the first wiring portion W1 drops in the first embodiment in which the fourth portion W24 is not formed is illustrated by a broken line and a state in which the voltage on the first wiring portion W1 drops in the configuration in which the fourth portion W24 is formed is illustrated by a solid line. As understood from FIG. 15, according to the fourth embodiment, the voltage drop on the first wiring portion W1 in the fourth portion W24 is suppressed. That is, the voltage drop of the voltage supplied to the piezoelectric element 44 corresponding to the nozzle N near the boundary B in each of the first nozzle group G1 and the second nozzle group G2 is suppressed.

FIG. 14 illustrates a liquid ejecting head 26[1] and a liquid ejecting head 26[2] which are adjacent to each other in the X direction. As understood from the above description, a difference in the voltage supplied to the piezoelectric element 44 is reduced in a nozzle N[1] located at a positive end portion of the first nozzle group G1 in the W direction in the liquid ejecting head 26[1] and a nozzle N[2] located at a negative end portion of the first nozzle group G1 in the W direction in the liquid ejecting head 26[2]. Therefore, it is possible to make the joint of an image in an overlapping portion of the adjacent ranges K in the X direction inconspicuous. In the above description, the first nozzle group G1 has been focused. However, the same effect is realized for the second nozzle group G2. The configuration of the second embodiment may be applied to the fourth embodiment.

Modification Example

Each embodiment illustrated above can be variously modified. Detailed modifications that can be applied to the above-described embodiments will be described as an example below. Two or more aspects selected from the following examples in a predetermined manner can be appropriately combined as long as the aspects do not contradict each other.

1. In each of the above-described embodiments, the wiring 72*a* that supplies the drive signal COM to the drive circuit 50 is formed in an annular shape. However, a wiring that is different from the wiring 72*a* that transmits the drive signal COM may be formed in an annular shape. For example, the wiring 72*c* that supplies the reference voltage VBS to the piezoelectric element 44 may be formed in an annular shape. However, since the voltage of the drive signal COM transmitted by the wiring 72*a* is larger than the voltages of the signals transmitted by the other wirings, the effect that the voltage drop can be suppressed by the configuration in which the wiring 72*a* is formed in an annular shape is particularly effective. Even in the configuration in which wirings other than the wiring 72*a* are formed in an annular shape, the effect that the voltage drop due to the resistance components of the wirings is suppressed is realized, which is like the case where the wiring 72*a* is formed in an annular shape.

2. In each of the above-described embodiments, the second wiring portion W2 forms an annular path over the entire first wiring portion W1. However, the second portion W22 may form an annular path with respect to a part of the first wiring portion W1. That is, in the X direction, the second portion W22 is located on one end side of the first wiring portion W1, and the third portion W23 is located on the other end side of the first wiring portion W1. However, the positions of the second portion W22 and the third portion W23 are not limited to the above-described examples. For example, the second portion W22 and the third portion W23 may be formed at positions in the middle of the first wiring portion W1 in the X direction. Even in the above-described configuration, the effect that the voltage drop in the first wiring portion W1 can be suppressed is realized. However, according to the above-described embodiments in which the second wiring portion W2 forms an annular path with respect to the entirety of the first wiring portion W1 corresponding to the array U, there is an advantage that the voltage drop is suppressed over the entire extending direction in the first wiring portion W1. The entire length of the first portion W21 can be changed as appropriate depending on the positions where the second portion W22 and the third portion W23 are formed.

3. A drive element that ejects a liquid in the pressure chamber C from the nozzle N is not limited to the piezoelectric element 44 exemplified in the above-described embodiments. For example, a heating element that generates bubbles in the pressure chamber C by heating to change the pressure may be used as the drive element. As understood from the above examples, the drive element is comprehensively expressed as an element for ejecting the liquid in the pressure chamber C from the nozzle N, and an operation method such as a piezoelectric method and a heating method and a specific configuration are not questioned.

4. The liquid ejecting apparatus 100 exemplified in the above-described embodiments may be adopted for various apparatuses such as a facsimile apparatus and a copying machine in addition to equipment dedicated to printing. However, usage of the liquid ejecting apparatus of the present disclosure is not limited to printing. For example, a liquid ejecting apparatus that ejects a solution of a color material is used as a manufacturing apparatus that forms a color filter of a display device such as a liquid crystal display panel. Further, a liquid ejecting apparatus that ejects a solution of a conductive material is used as a manufacturing apparatus that forms a wiring and an electrode of a wiring substrate. Further, a liquid ejecting apparatus that ejects an organic solution related to a living body is used as, for example, a manufacturing apparatus that manufactures a biochip.

5. The liquid ejecting head 26 exemplified in the above-described embodiments is an example of a piezoelectric device. As a piezoelectric device other than the liquid ejecting head 26, there is provided, for example a: a correction actuator for correcting a focus shift of a lens due to shaking of an imaging apparatus such as a still camera and a video camera, b: an ultrasonic device such as an ultrasonic cleaner, an ultrasonic diagnostic device, a fish finder, an ultrasonic oscillator, and an ultrasonic motor, c: various filters such as a filter for blocking harmful rays such as infrared rays, an optical filter using a photonic crystal effect by quantum dot formation, and an optical filter using optical interference of a thin film, and d: various devices such as a temperature-electricity converter, a pressure-electricity converter, a ferroelectric transistor and a piezoelectric transformer.

Further, the present disclosure is also applied to a piezoelectric element used as a sensor or a piezoelectric element used as a ferroelectric memory. Examples of the sensor using the piezoelectric element include an infrared sensor, an ultrasonic sensor, a thermal sensor, a pressure sensor, a pyroelectric sensor, an angular velocity sensor, and the like.

What is claimed is:

1. A liquid ejecting head comprising:

a plurality of drive elements for ejecting liquids from nozzles, respectively;

a base portion; and a wiring formed on the base portion to drive the plurality of drive elements, wherein the wiring includes a first wiring portion formed along an array of the plurality of drive elements, and a second wiring portion forming an annular path with respect to the first wiring portion.

2. The liquid ejecting head according to claim 1, wherein the drive elements are piezoelectric elements.

3. The liquid ejecting head according to claim 1, further comprising:

a drive circuit that controls supply of a drive signal to each of the plurality of drive elements, wherein the wiring supplies the drive signal to the drive circuit.

4. The liquid ejecting head according to claim 1, wherein the second wiring portion includes a first portion formed along the array of the plurality of drive elements, a second portion connecting the first wiring portion and the first portion, and a third portion connecting the first wiring portion and the first portion.

5. The liquid ejecting head according to claim 4, wherein in a direction in which the plurality of drive elements are arranged, the second portion is located on one side when viewed from the array, and the third portion is located on the other side when viewed from the array.

6. The liquid ejecting head according to claim 4, wherein the first wiring portion is formed on a first surface of the base portion, the first portion is formed on a second surface that is opposite to the first surface of the base portion, and the second portion and the third portion penetrate the base portion.

7. The liquid ejecting head according to claim 4, wherein the first wiring portion and the second wiring portion are formed on the same surface of the base portion.

8. A liquid ejecting apparatus comprising:

the liquid ejecting head according to claim 1; and a controller that controls the liquid ejecting head.

9. A liquid ejecting unit in which a plurality of liquid ejecting heads each including a first nozzle group including a plurality of nozzles that eject a first liquid and a second nozzle group including a plurality of nozzles that eject a second liquid are arranged in a first direction, wherein the plurality of liquid ejecting heads are arranged in the first direction such that the nozzles are arranged along a second direction inclined with respect to the first direction, ranges of the first nozzle groups in the first direction partially overlap each other over the plurality of liquid ejecting heads, and ranges of the second nozzle groups in the second direction overlap each other over the plurality of liquid ejecting heads, each of the plurality of liquid ejecting heads includes a plurality of drive elements that eject liquids from the nozzles, respectively, a base portion, and a wiring formed on the base portion to drive the plurality of drive elements, the wiring includes a first wiring portion formed along an array of the plurality of drive elements, and a second wiring portion forming an annular path with respect to the first wiring portion, and the second wiring portion includes a first portion that is formed along the array of the plurality of drive elements, a second portion that is formed on one side when viewed from the array in a direction in which the plurality of drive elements are arranged and connects the first wiring portion and the first portion, a third portion that is formed on the other side when viewed from the array in a direction in which the plurality of drive elements are arranged and connects the first wiring portion and the first portion, and a fourth portion that is formed at a position corresponding to a boundary between the first nozzle group and the second nozzle group in the direction in which the plurality of drive elements are arranged and connects the first wiring portion and the first portion.

10. A liquid ejecting apparatus comprising:

the liquid ejecting unit according to claim 9; and a controller that controls the liquid ejecting unit.

11. A piezoelectric device comprising:

a plurality of piezoelectric elements that eject liquids from nozzles, respectively;

a base portion; and a wiring formed in the base portion to drive the plurality of piezoelectric elements, wherein the wiring includes a first wiring portion formed along an array of the plurality of piezoelectric elements, and a second wiring portion forming an annular path with respect to the first wiring portion.

* * * * *